US005516560A

United States Patent [19]

Harayama et al.

[11] Patent Number: 5,516,560

[45] Date of Patent: May 14, 1996

[54] METHOD FOR COATING RINGS, COATING EQUIPMENT AND COATING JIG

[75] Inventors: Akria Harayama, Okaya; Katsuhiro Nagata, Toyota, both of Japan

[73] Assignees: Teikoku Piston Ring Co., Ltd., Tokyo; Asahi Chiyoda Kogyo Co., Ltd., Owariasahi, both of Japan

[21] Appl. No.: 326,390

[22] Filed: Oct. 20, 1994

[30] Foreign Application Priority Data

Oct. 26, 1993 [JP] Japan ..... 5-290120

[51] Int. Cl.[6] ..... B05D 7/00

[52] U.S. Cl. ..... 427/425; 427/421; 29/888.074

[58] Field of Search ..... 427/421, 425; 29/888.074

[56] References Cited

U.S. PATENT DOCUMENTS 2,119,035 5/1938 Ballard ..... 29/888.074

5,241,748 9/1993 Ishida ..... 29/888.074

*Primary Examiner*—Shrive Beck

*Assistant Examiner*—David M. Maiorana

*Attorney, Agent, or Firm*—Armstrong, Westerman, Hattori, McLelland & Naughton

[57] ABSTRACT

A plurality of piston rings 70 are set at intervals in the axial direction, on the outer circumference of a cylindrical member 6 of a coating jig 5. The coating jig 5 is supported to allow horizontal rotation and conveyed to the coating process by a chain conveyor 40. In the coating process, simultaneously with the rotation of the coating jig 5 by a drive means 51, a pair of coating guns 54 and 55 placed at a position above the coating jig 5, apply a coating to the upper surfaces 70*a* and the lower surfaces 70*b* of the piston rings 70 while moving along the axial direction of the coating jig 5.

2 Claims, 10 Drawing Sheets

56
6
70
8
39
6
70b
70c
70a
VII
VII 5
7
12
70

METHOD FOR COATING RINGS, COATING EQUIPMENT AND COATING JIG

BACKGROUND OF THE INVENTION

1. Field of the Invention

This invention relates to technology for applying a coating to at least upper surfaces or the lower surfaces of rings having upper and lower surfaces, an inner circumferential surface and an outer circumferential surface and having a gap forming a pair of end surfaces, and is preferably utilized for instance, to coat piston rings, snap rings, and the like.

2. Description of the Related Art

The application of a coating of synthetic resin containing solid lubricant to the lower surface, or the upper and lower surfaces, of a piston ring is performed on certain piston rings to attain the objectives listed below.

1) To prevent the piston ring material, aluminum, from adhering to the piston ring surface.

2) To prevent roughing of the piston ring groove.

3) To alleviate wear on the piston ring groove.

4) And to improve break-in conformity between the piston ring groove and the upper and lower surfaces of the piston ring.

A coating film formed on the lower surface, or the upper and lower surfaces of the piston ring generally, has a thickness of 5 to 10 μm and this film is required to have good adhesion, no damage, no intrusion of foreign matter, and a uniform thickness. In many cases, adherence of coating material to the outer circumferential surface of the piston ring is overlooked.

The conventional method for covering the upper and lower surfaces of a piston ring with a synthetic resin containing solid lubricant will be hereinafter described.

As shown in FIG. 10, a plurality of piston rings 70 are placed onto the surface of a metal net 60. The size of the metal net 60 is approximately 500 mm×400 mm and the size of the holes in the net is approximately 5 mm×5 mm. Approximately fifty piston rings 70 can be placed onto the metal net 60. Many piston rings 70 are placed on the metal net 60 with as little space between them as possible, in order to reduce wasteful coating material. The piston rings 70 are arranged by hand onto the metal net 60 in rows, requiring a large amount of time.

The piston rings 70 loaded on the metal net 60 are transported to the preheating oven by conveyor and preheated. Next, the piston rings 70 are sent to the coating booth provided with a coating robot. The coating robot coats the piston rings 70 by moving a coating gun above the metal net 60 in a lattice pattern. When coating of one side of the piston ring 70 is complete, the piston rings 70 are sent to a pre-baking furnace and pre-baking is performed. When coating the upper and lower surfaces of the piston ring 70, the piston rings 70 on the metal net 60 are reversed and the above process is then repeated once again. When pre-baking is complete, the piston rings 70 are sent to a baking furnace and baked completely.

However the above method has the following disadvantages.

1) Since the piston rings 70 cannot be placed on the metal net 60 without spaces, much coating material misses the piston ring 70 and wastefully adheres to the metal net 60.

2) Much labor time is required to arrange the rows of the piston rings 70. Also, much time is required to reverse the piston rings 70, when coating the upper and lower surfaces of the piston rings 70.

3) Since the spaces between the piston rings 70 and the adjacent piston rings 70 are not uniform, the adherence of coating material in the circumferential direction of the piston ring 70 is irregular, and in particular the thickness of the coating film on the outer circumferential surface is irregular.

4) Non-uniform temperatures occur between portions being in contact with the metal net 60 and other portions not being in contact with the metal net 60 in the piston ring 70, since the piston ring 70 is placed on the metal net 60. These non-uniform temperatures cause variations in the adhesion of the coating film.

5) Foreign matter, dust or scratches tend to be present on the coating film formed on the piston ring 70 when the piston ring 70 on the metal net 60 is reversed.

6) During arrangement, the reversal process or conveyor transport of the piston rings 70 on the metal net 60, the piston ring 70 tends to move around on the metal net 60 and the following problem occurs. Namely, the piston rings 70 pile atop one another, causing uncoated portions to occur in the surface of the piston ring 70. Also when undried rings make contact with undried rings or the net holes, metal-to-metal contact occurs locally, causing burrs to occur in the coating film and causing variations in the thickness of the coating film.

7) The openings in the metal net 60 gradually become smaller as the coating process is repeated, making frequent replacement of the metal net 60 necessary.

SUMMARY OF THE INVENTION

It is an object of the present invention to provide a coating application technology attaining a high quality of coating film and a uniform coating thickness for a ring.

This invention is a coating application technology for rings having upper and lower surfaces, an inner circumferential surface and an outer circumferential surface and having a gap forming a pair of end surfaces comprising: setting a plurality of rings at spaced intervals in the axial direction of said ring, rotating said rings about the axis of said ring, and coating at least the upper surfaces or the lower surfaces of said rings while a coating gun is being moved along the direction of the row of said rings.

This method provides a coating film with a uniform thickness and also provides a high quality coating film.

BRIEF DESCRIPTION OF THE DRAWINGS

The aforesaid and other objects and features of the present invention will become more apparent from the following detailed description and the accompanying drawings.

DESCRIPTION OF THE PREFERRED EMBODIMENTS

Figure 2:
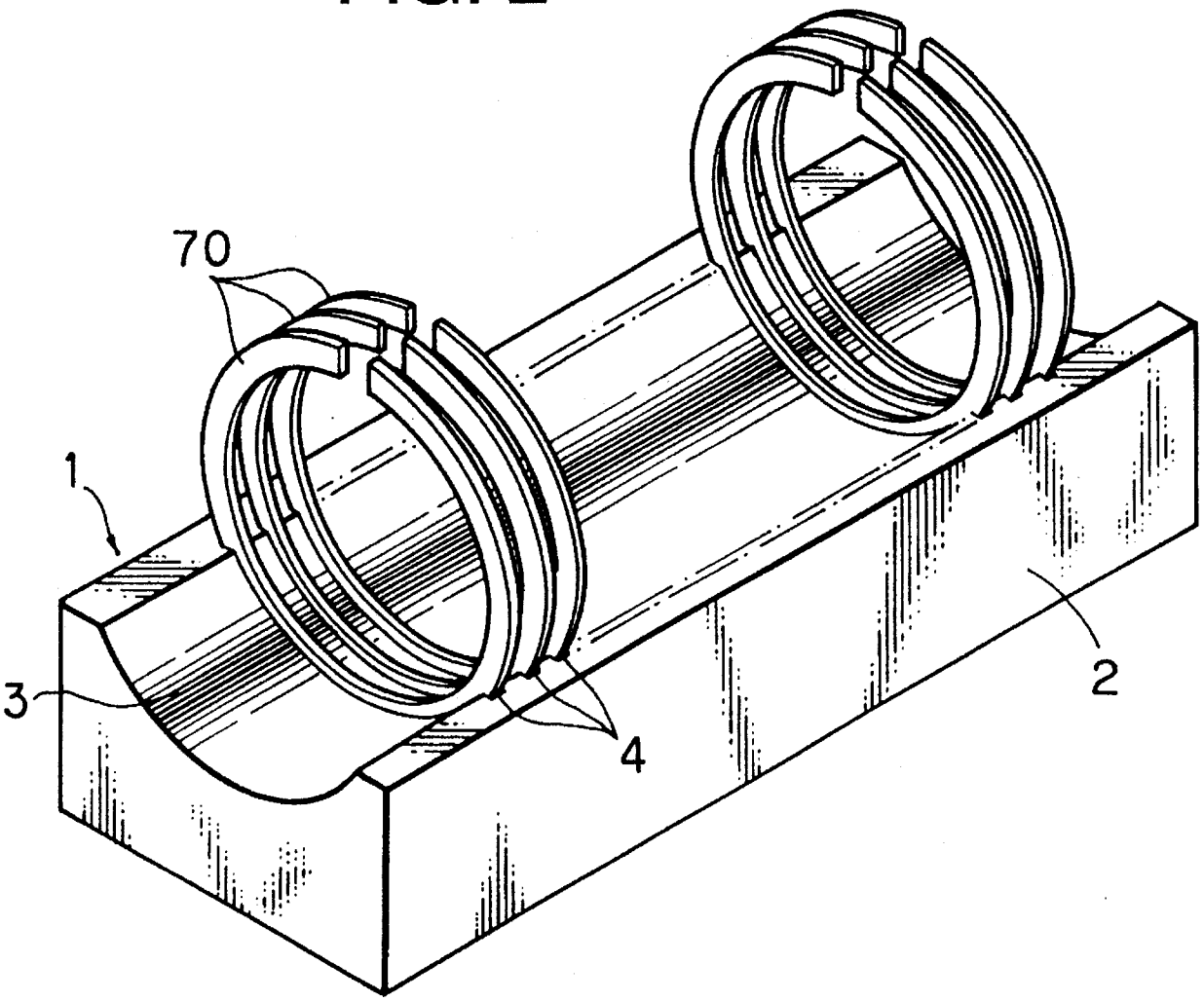
FIG. 2 is a perspective view showing a lining jig in which piston rings are arrayed in a row.
Figure 3:
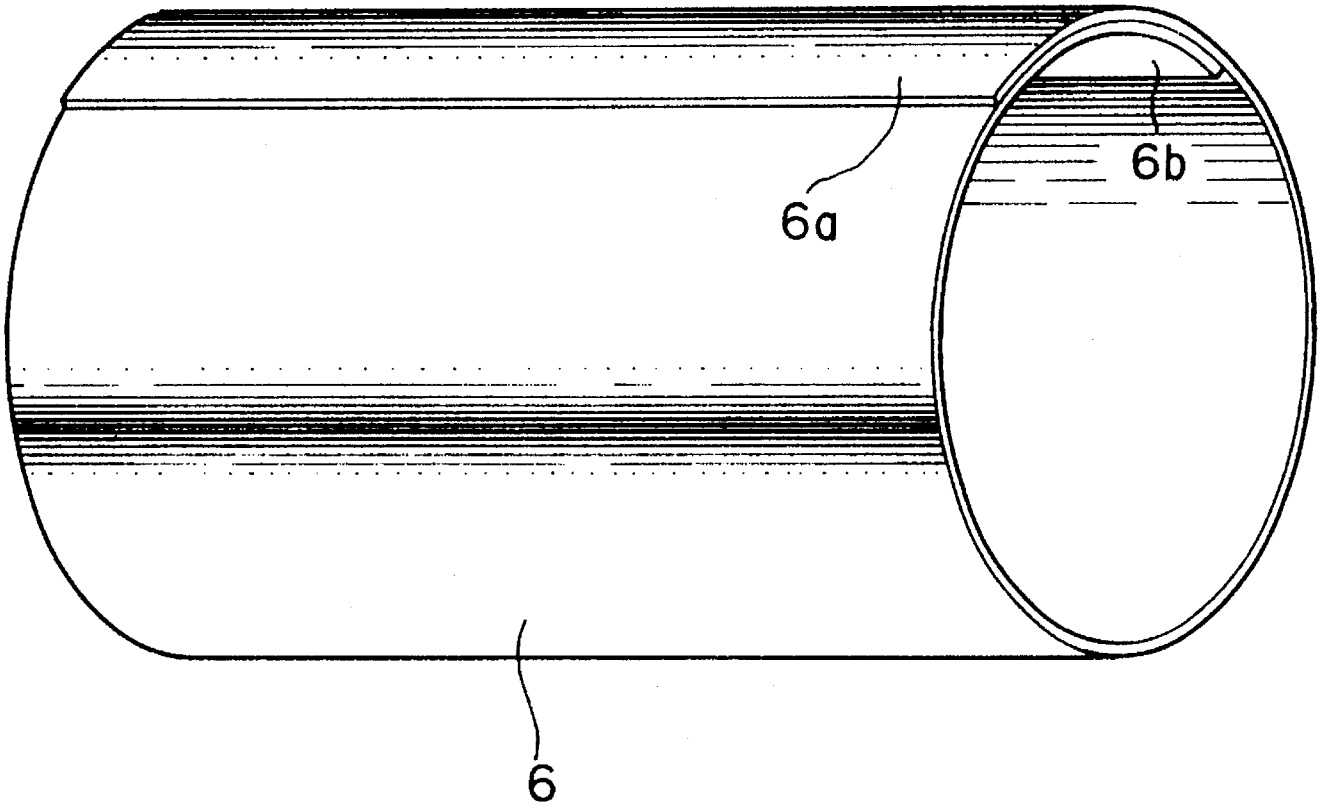
FIG. 3 is a perspective view showing a cylindrical member.
Figure 4:
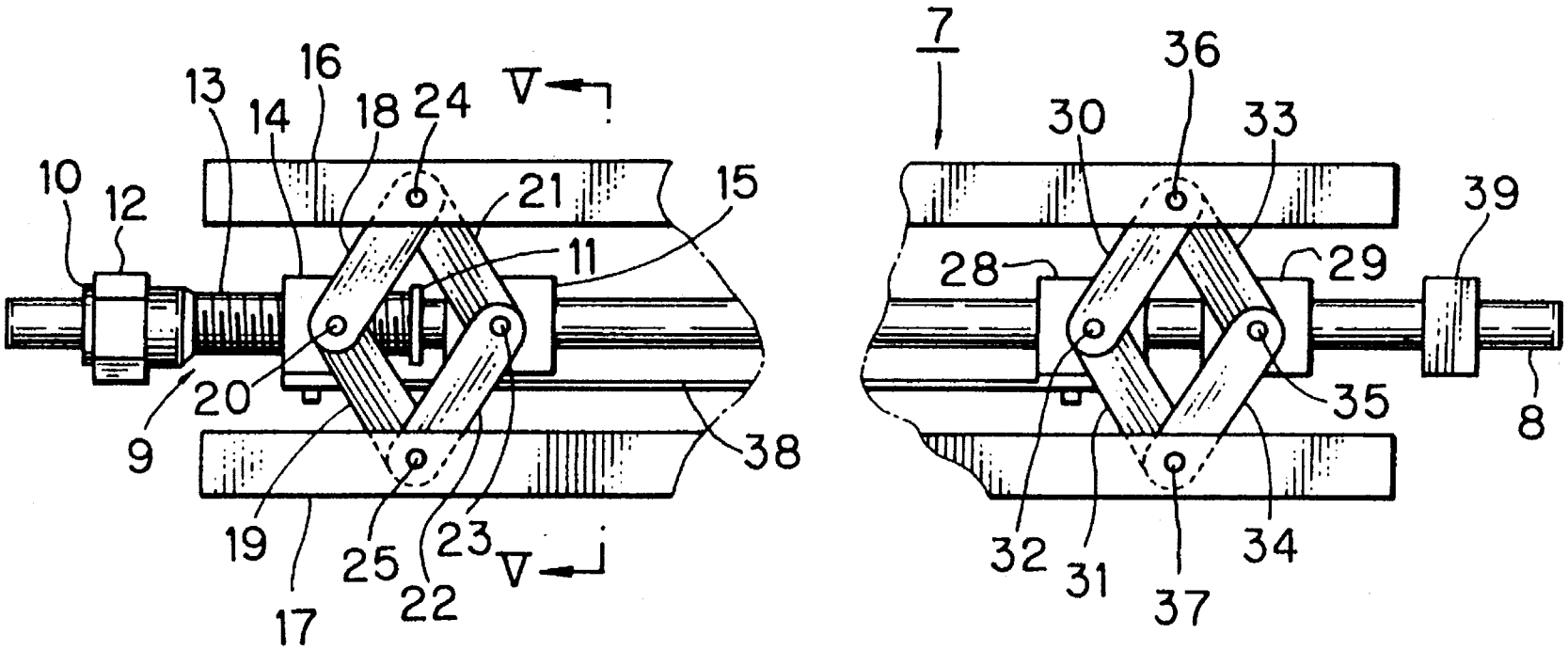
FIG. 4 is a fragmentary, abbreviated front view of an expansion member.
Figure 5:
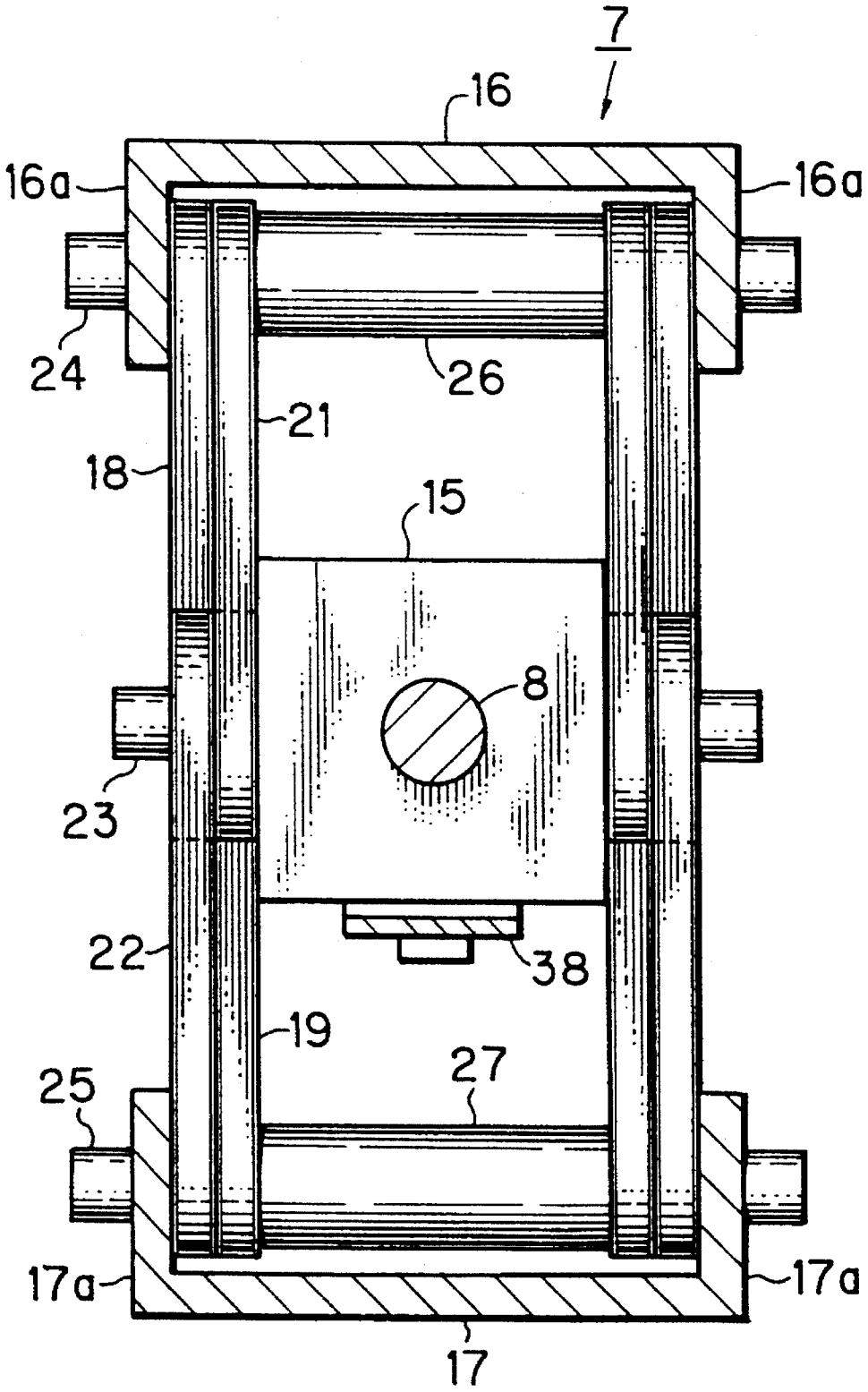
FIG. 5 is a cross-sectional view taken along the line V—V in FIG. 4.
Figures 6, 6A:
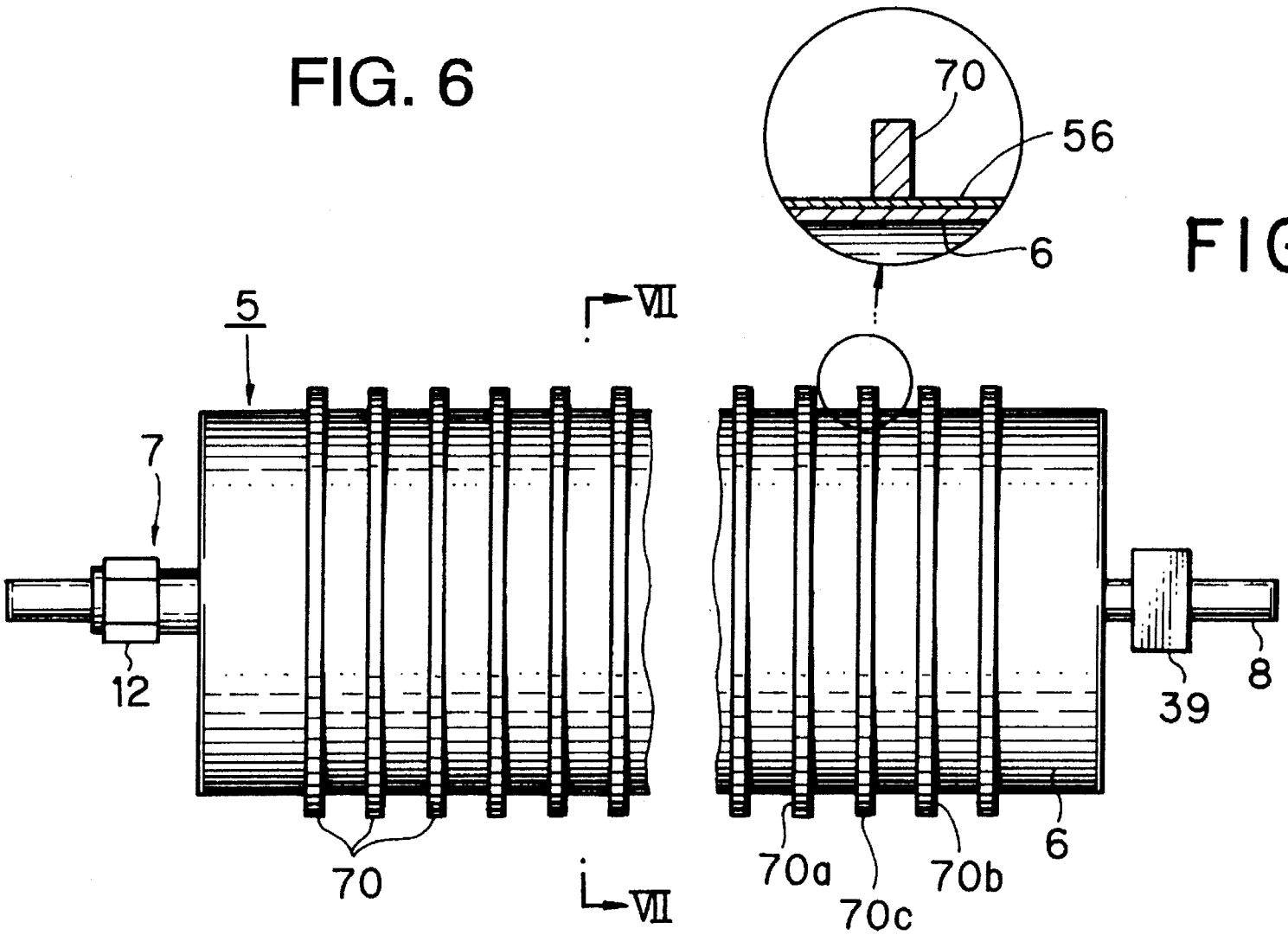
FIG. 6 is a fragmentary, abbreviated front view of a coating jig on which piston rings are fixed.
Figure 7:
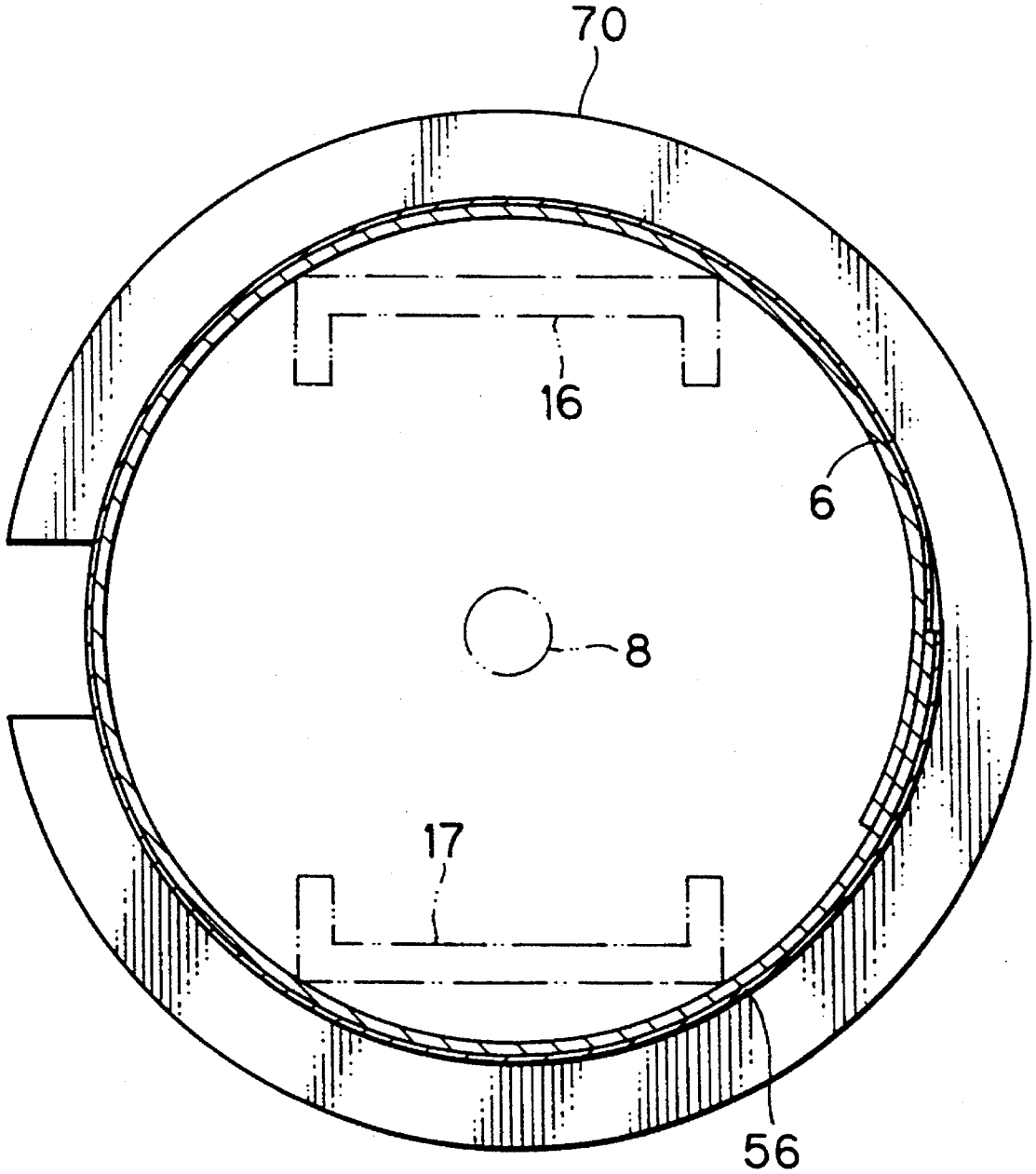
FIG. 7 is a cross-sectional view taken along the line VII—VII in FIG. 6.

FIG. 2 shows a lining jig for arraying a plurality of piston rings 70 at spaced intervals in the axial direction of the piston ring 70. This lining jig 1 has a long, slender rectangular block 2. At the upper surface of the block 2 is a concave surface 3 forming an arc shape across the width of the block 2 and spanning the length of the block 2 in the longitudinal direction. At the concave surface 3, a plurality of arc-shaped grooves 4 are formed at the same spaced intervals in the longitudinal direction to receive the piston rings 70. This block 2, rather than the concave surface of arc shape, may have a V-shaped surface on which a plurality of V-shaped grooves are formed at the same spaced intervals in the longitudinal direction to receive the piston rings.

A coating jig 5 is shown in FIG. 1 and FIGS. 3 through 7 and comprises a cylindrical member 6 and an expansion member 7.

The cylindrical member 6 is a member on whose outer circumference the piston rings 70 are placed. The cylindrical member 6 is of a thin wall and an outer diameter smaller than the inner diameter of the piston ring 70 and with a pair of circumferential ends 6*a* and 6*b* overlapping each other.

The expansion member 7 is inserted in the cylindrical member 6 and expands the cylindrical member 6 outwards to secure the piston ring 70 to the outer circumference of the cylindrical member 6. A rod 8 is provided at the center of the expansion member 7. A control pipe 9 is rotatably inserted in one end of the rod 8. A pair of snap rings 10 and 11 mounted on the rod 8 prevent axial movement of the control pipe 9. The control pipe 9 has a hexagonal wrench engagement section 12 formed at one end, and a male screw section 13 with a male screw formed on the outer circumference. A screw block 14 formed with a female screw on the inner circumference is mounted to engage with the male screw section 13 of the control pipe 9. A fixed block 15 is fixed on the rod 8 at a position adjacent to the control pipe 9.

A pair of expansion pieces 16 and 17 are provided respectively above and below the rod 8. The upper expansion piece 16 is of a channel shape which is open on the lower side and the lower expansion piece 17 is of a channel shape which is open on the upper side.

At one side of the screw block 14, a pair of links 18 and 19 are rotatably connected by a pin 20. At one side of the fixed block 15, a pair of links 21 and 22 are rotatably connected by a pin 23. The first link 18 connected to the side of the screw block 14, and the first link 21 connected to the side of the fixed block 15 are rotatably connected to a pin 24 mounted between opposed side pieces 16*a* and 16*a* of the upper expansion piece 16. In the same way, the second link 19 connected to the side of the screw block 14, and the second link 22 connected to the side of the fixed block 15 are rotatably connected to a pin 25 mounted between opposed side pieces 17*a* and 17*a* of the lower expansion piece 17.

Links are connected in the same manner described above to the other sides of the screw block 14 and the fixed block 15, and are connected respectively to the pins 24 and 25 attached to the upper and lower expansion pieces 16 and 17. Spacers 26 and 27 are inserted respectively in the mid-sections of the pins 24 and 25.

A slide block 28 and a fixed block 29 are mounted on the rod 8 near the end opposite from the control pipe 9. The slide block 28 is mounted to be slideable on the rod 8. The fixed block 29 is secured to the rod 8 at a position nearer to the end of the rod 8 than the position of the slide block 28.

On one side of the slide block 28, a pair of links 30 and 31 are rotatably connected by a pin 32. On one side of the fixed block 29, a pair of links 33 and 34 are rotatably connected by a pin 35. The first link 30 connected to the side of the slide block 28, and the first link 33 connected to the side of the fixed block 29 are rotatably connected to a pin 36 mounted between the opposed side pieces 16*a* and 16*a* of the upper expansion piece 16. In the same way, the second link 31 connected to the side of the slide block 28, and the second link 34 connected to the side of the fixed block 29 are rotatably connected to a pin 37 mounted between the opposed side pieces 17*a* and 17*a* of the lower expansion piece 17.

Links are connected in the same manner as related above, to the other sides of the slide block 28 and the fixed block 29, and are connected respectively to the pins 36 and 37 attached to the upper and lower expansion pieces 16 and 17. Spacers are inserted respectively in the mid-sections of the pins 36 and 37.

The lower surface of the screw block 14 and the lower surface of the slide block 28 are connected to each other by a connecting rod 38.

A rectangular block 39 is provided in the rod 8 near the end opposite from the control pipe 9. The rod 8 is prevented from rotating during the rotation of the control pipe 9 by the insertion of the rectangular block 39 in a rectangular hole formed in a fixed block (not shown).

Therefore, by rotating the wrench engagement section 12 of the control pipe 9 with a hex wrench, the control pipe 9 is made to rotate about its axis. When the screw block 14 moves on the male screw section 13 of the control pipe 9 toward the fixed block 15, by means of rotation of the control pipe 9, the slide block 28 connected to the screw block 14 also moves toward the fixed block 29. As a result, the pair of expansion pieces 16 and 17 expand by being moved respectively up and down by the links.

The expanded pair of expansion pieces 16 and 17 apply pressure to the cylindrical member 6 to expand it outwards. The expanded cylindrical member 6, in turn, expands the piston rings 70 placed on the outer circumference of the cylindrical member 6. As a result, the contraction force of the piston rings 70 secures them to the outer circumference of the cylindrical member 6.

As related above, the pair of expansion pieces 16 and 17 of the expansion member 7 are expanded up and down by the pantograph mechanism while being maintained in parallel relative to the axis of the cylindrical member 6. Consequently, this uniform expansion of the cylindrical member 6 allows the piston rings 70, placed in the outer circumference of the cylindrical member 6, to be reliably secured to the outer circumference of the cylindrical member 6.

The mutual gap between the piston rings 70 mounted in the coating jig 5 is preferably 2.5 times the radial thickness of the piston ring or more, to ensure a uniform coating thickness. A minimum mutual gap between the piston rings should be 1.73 times the radial thickness of the piston ring.

As an example of dimensions of the cylindrical member 6 in the coating jig 5, a thickness of 0.3 mm, inner diameter of 60 mm, length of 400 mm and an overlapping width of 50 mm in the circumferential direction are typical for a piston ring diameter of 85 mm. This cylindrical member can be made in a cylindrical shape, of stainless steel sheet.

Figure 1:
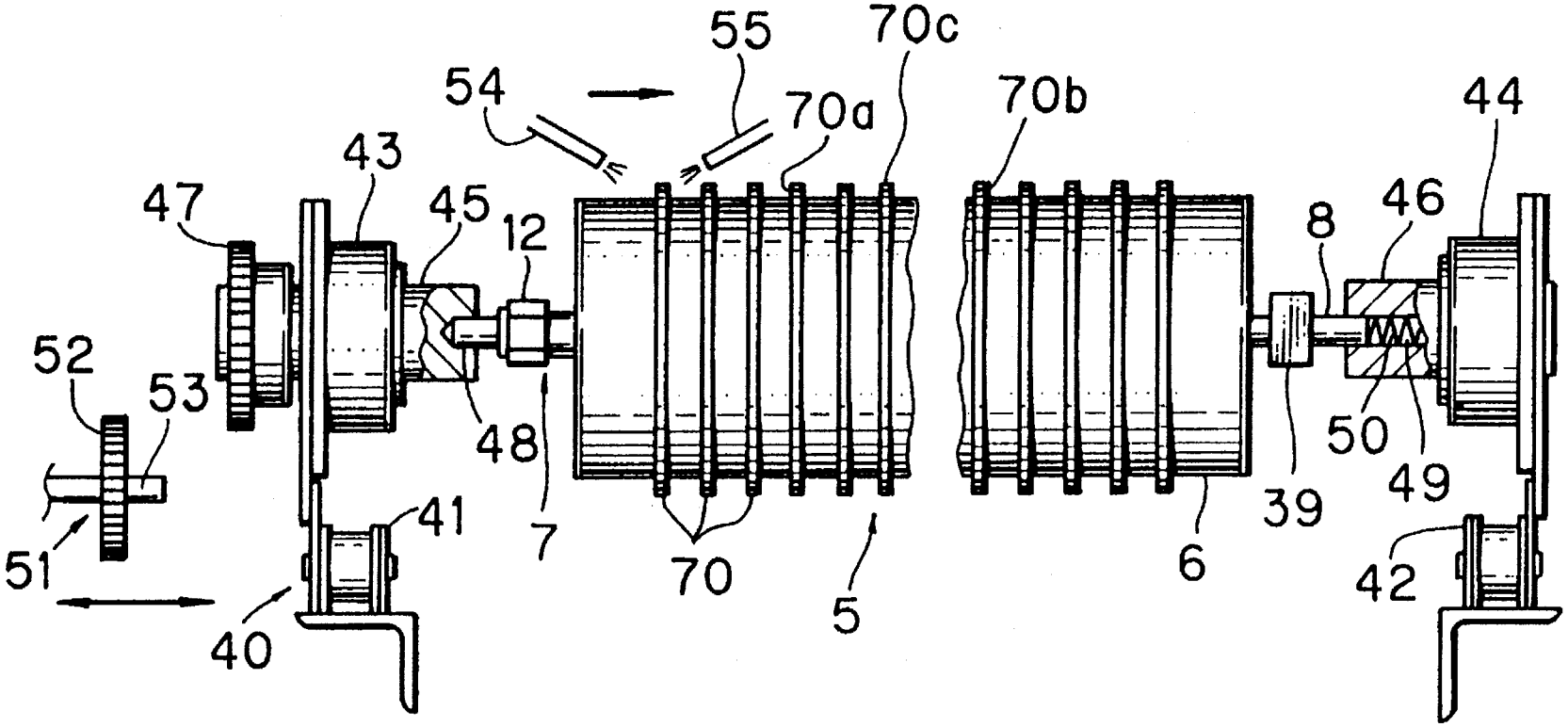
FIG. 1 is a fragmentary, abbreviated front view of a coating equipment of one embodiment of the present invention.

As shown in FIG. 1, the coating jig 5 is held on a chain conveyor 40 and transported. The chain conveyor 40 is provided with a pair of chains 41 and 42. Each of the chains 41 and 42 constitutes an endless circle in a vertical plane. Bearings 43 and 44 are respectively set in positions facing each other at the upper end of the chains 41 and 42. The bearings 43 and 44 rotatably support shafts 45 and 46 respectively. The shafts 45 and 46 are horizontal and vertically supported with respect to the direction of the movement of the chain conveyor 40. The shaft 45 passes through the inner and outer sides of the bearing 43, and the outer protruding portion is provided with a gear 47, and the inner protruding portion is provided with a hole 48 which is formed horizontally and opens at the center portion of the end surface. The other shaft 46 protrudes through the inner side of the bearing 44, and the inner protruding portion is provided with a hole 49 which is formed horizontally and opens at the center portion of the end surface. A coil spring 50 is inserted in the hole 49.

The coating jig 5 is supported by the right and left chains 41 and 42, since both ends of the rod 8 of the expansion member 7 are inserted in the holes 48 and 49 of the pair of shafts 45 and 46.

The coating jig 5 on which the piston rings 70 are set is conveyed to various processes in sequence; pre-heating (pre-heating oven), coating (coating booth) and pre-baking (pre-baking furnace) while supported on the chain conveyor 40.

A coating booth is provided with a drive means to rotate the coating jig 5 about its axis during the coating process. The drive means 51 is gear mechanism driven by a motor. When the coating jig 5 conveyed by the chain conveyor 40, stops at the coating position in the coating booth, a gear 52 which is a part of the gear mechanism of the drive means 51 is moved by a shaft 53 to mesh with the gear 47 of the chain conveyor 40 and to rotate the gear 47 of the chain conveyor 40. The rod 8 of the coating jig 5 is forced by the coil spring 50 in the shaft 46 in the chain conveyor 40 to be pressed against the other shaft 45, allowing integrated rotation with the shafts 45 and 46 so that the coating jig 5 rotates along with the shafts 45 and 46 by the rotation of the gear 47.

In the coating booth, the coating application is performed by means of coating guns while the coating jig 5 is rotated. A pair of coating guns 54 and 55 are provided, and positioned above the coating jig 5 which is held by the chain conveyor 40 in the coating booth. The pair of coating guns 54 and 55 are located near the end of the coating jig 5 in the axial direction. The axis of the coating guns 54 and 55 is inclined 30 to 45 degrees in relation to the axis of the coating jig 5 with the spray outlets of the coating guns 54 and 55 pointed diagonally downwards. The pair of coating guns 54 and 55 can be moved back and forth along the axial direction of the coating jig 5.

During the coating application, the pair of coating guns 54 and 55 are moved along the axial direction of the coating jig 5, and upon reaching a position above the piston rings 70, the spray outlets of the pair of coating guns 54 and 55, are arrayed in symmetrical positions with respect to the piston rings 70. At this time, the spray outlet of the coating gun 54 is pointed at the upper surface **70*a* of the piston ring 70, and the spray outlet of the other coating gun 55 is pointed at the lower surface 70*b* of the piston ring 70 such that the upper and lower surfaces 70*a* and 70*b* of the piston ring 70 are coated simultaneously by the pair of coating guns 54 and 55**.

In applying a coating to the upper and lower surfaces **70*a* and 70*b* of the piston ring 70, if the other surface is coated after one surface is coated, the other surface is cooled when one surface is coated, allowing the preheated temperature of the other surface to drop, enabling an unsatisfactory coating to be applied. The coating distance of the coating guns 54 and 55 is adjustable and the inclination angle of the coating guns 54 and 55 is also adjustable with respect to the axial direction of the coating jig 5**.

At an inclination of 30 degrees, the coating film thickness of the outer circumferential surface **70*c*, and the upper and lower surfaces 70*a* and 70*b* of the piston ring 70 has a ratio of approximately 1. However, at an inclination of 45 degrees, the ratio is approximately 2. In this way, the coating film thickness of the outer circumferential surface 70*c*, and the upper and lower surfaces 70*a* and 70*b* of the piston ring 70 can be controlled by changing the inclination of the coating guns 54 and 55**.

The following describes the coating application on the upper and lower surfaces of a plurality of piston rings using synthetic resin containing solid lubricant. Molybdenum disulfide or graphite may for instance be used in the solid lubricant. Polytetrafluoroethylene resin or polyimide resin may, for instance, be used in the synthetic resin.

The plurality of piston rings 70 are first inserted into the arc-shaped grooves 4 in the lining jig 1 to be arrayed at the same spaced intervals in the axial direction. This arraying operation can be done by hands and automation of the process is also possible.

Next, the plurality of piston rings 70 arrayed in the lining jig 1 are set to the coating jig 5 as described below.

First, the cylindrical member 6 is inserted inside the piston rings 70 arrayed in the lining jig 1. The cylindrical member 6 can be easily inserted within the inner circumference of the piston rings 70, since the outer diameter of the cylindrical member 6 is smaller than the inner diameter of the piston rings 70.

The expansion member 7 is then inserted inside the cylindrical member 6. Next, the control pipe 9 is rotated about its axis by applying a hex wrench to the wrench engagement section 12 of the control pipe 9 in the expansion member 7 and rotating it. When the control pipe 9 is rotated, the screw block 14 moves on the male screw section 13 of the control pipe 9 toward the fixed block 13, and at the same time, the slide block 28 connected to the screw block 14 is moved toward the fixed block 29. As a result, the pair of expansion pieces 16 and 17 expand by being moved respectively up and down by the links.

The expanded pair of expansion pieces 16 and 17 expand the cylindrical member 6, and this expansion of the cylindrical member 6 causes the plurality of piston rings 70 to expand. Consequently, the piston rings 70 are secured by the contraction force to the outer circumference of the cylindrical member 6. The piston ring 70 is reliably secured by its own contraction force when the gap of the piston ring is widened by approximately 1 mm. There is no damage to the piston ring 70 at this time.

The actual use of a sheet, such as thin paper 56 (refer to FIG. 6 and FIG. 7) capable of absorbing coating material between the cylindrical member 6 and the piston rings 70 is recommended. Therefore, it is preferable to wind the thin paper 56 beforehand, around the outer circumference of the cylindrical member 6. Rough paper or similar materials will prove ideal for this job. Use of a thin paper with printing or a surface coating is not recommended.

Winding the thin paper 56 around the outer circumference of the cylindrical member 6 to absorb the coating material during application of the coating prevents the coating material from adhering to the outer circumference of the cylindrical member 6. Consequently, the same cylindrical member 6 can be used repeatedly. The thin paper 56 moreover has the advantage of not burning at temperature in the preheating oven and pre-baking furnace and allows the condition of the coating guns 54 and 55 to be found by evaluating the quality of the coating on the thin paper 56. For instance, if the coating is mottled or thin, the coating guns are found to be in poor condition. Since the thin paper 56 absorbs the coating material, burrs are prevented from occurring on portions making contact with the cylindrical member 6 at the inner circumferential sides of the upper and lower surfaces 70*a* and 70*b* of the piston ring 70. The thin paper 56 is inexpensive, allowing it to be replaced after using both surfaces.

The coating jig 5 on which the plurality of piston rings 70 are set, is attached to the chain conveyor 40. More specifically, one end of the rod 8 in the coating jig 5 is push-inserted into the hole 49 of the shaft 46 in the chain conveyor 40, and the other end of the rod 8 is inserted into the hole 48 of the other shaft 45.

The coating jig 5 while supported horizontally in the chain conveyor 40 is first conveyed to the preheating oven and the piston rings 70 are then preheated uniformly to a specified temperature.

The coating jig 5 is next transported to the coating booth by the chain conveyor 40, and prior to the coating application, dust and foreign matter are blown off from the surface of the piston rings 70 by heated air.

When the coating jig 5 is conveyed and stops at the coating position in the coating booth, the gear 52 which is a part of the gear mechanism of the drive means 51 is moved by the shaft 53 to mesh with the gear 47 of the chain conveyor 40. As a result, the gear 47 of the chain conveyor 40 is rotated and the coating jig 5 rotates along with the shafts 45 and 46 by the rotation of the gear 47.

When the coating jig 5 is rotated, the pair of coating guns 54 and 55, simultaneously apply a coating to the upper surfaces 70*a* and the lower surfaces 70*b* of the plurality of piston rings 70, while moving along the axial direction of the coating jig 5.

There is no gap in the circumference since the pair of ends 6*a* and 6*b* of the cylindrical member 6 are overlapped. Therefore, there is no possibility of the coating material being blown into the interior of the cylindrical member 6 during the coating application. Consequently, the coating material is prevented from being blown onto the expansion member 7 located inside the cylindrical member 6, thus allowing repeated use of the coating jig 5.

In contrast to the surface spray application of the conventional coating in which the coating gun had to move back and forth, right and left, control of the coating gun for the application of the coating in the present invention is simple since the coating gun moves in a straight line.

In the example described above, the pair of coating guns 54 and 55 were used. However, when coating only the lower surface 70*b* of the piston ring 70, use only of the coating gun 55 is sufficient.

Preferable conditions for coating piston rings with an outer diameter of 85 mm are listed below.

Distance between the coating gun and the coating jig: 75 mm

Rotation speed of the coating jig: 175 rpm

Movement speed of the coating gun: 2 mm/s

Tilt angle of the coating gun: 30°

When coating of the upper and lower surfaces 70*a* and 70*b* of the piston rings 70 is complete, the gear 52 of the drive means 51, separates from the gear 47 of the chain conveyor 40, and the piston rings 70 are conveyed to the pre-baking furnace by the chain conveyor 40 for pre-baking.

When pre-baking is complete, the coating jig 5 is removed from the chain conveyor 40 and the piston rings 70 are removed from the coating jig 5. These piston rings 70 are then fully baked in the baking furnace.

The chain conveyor line may also be altered to accomodate the complete baking process. In such a case, the pre-baking process can be eliminated.

Figure 8B:
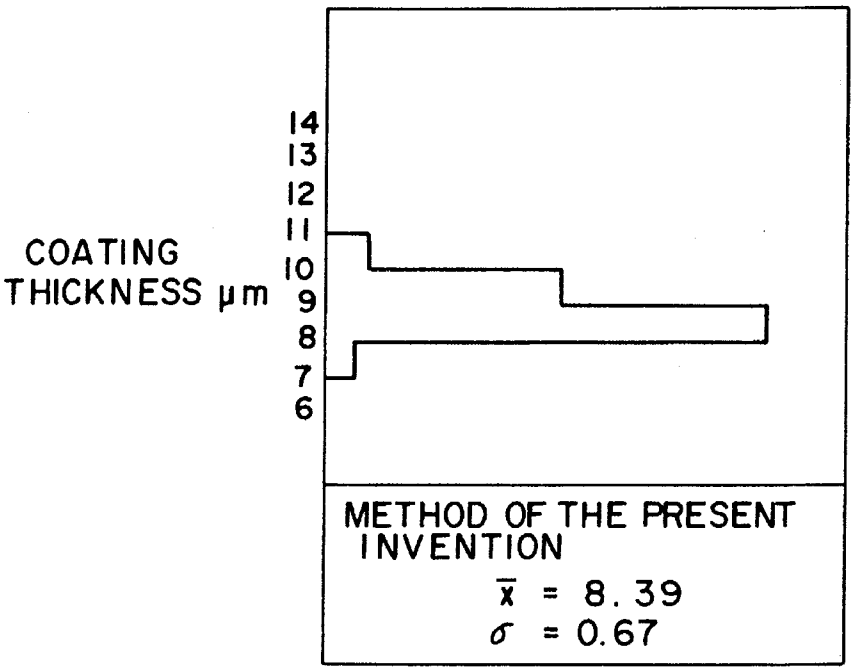
FIG. 8 is a graph showing the thickness distribution of the coating film on the lower surface of the piston ring.
Figure 8A:
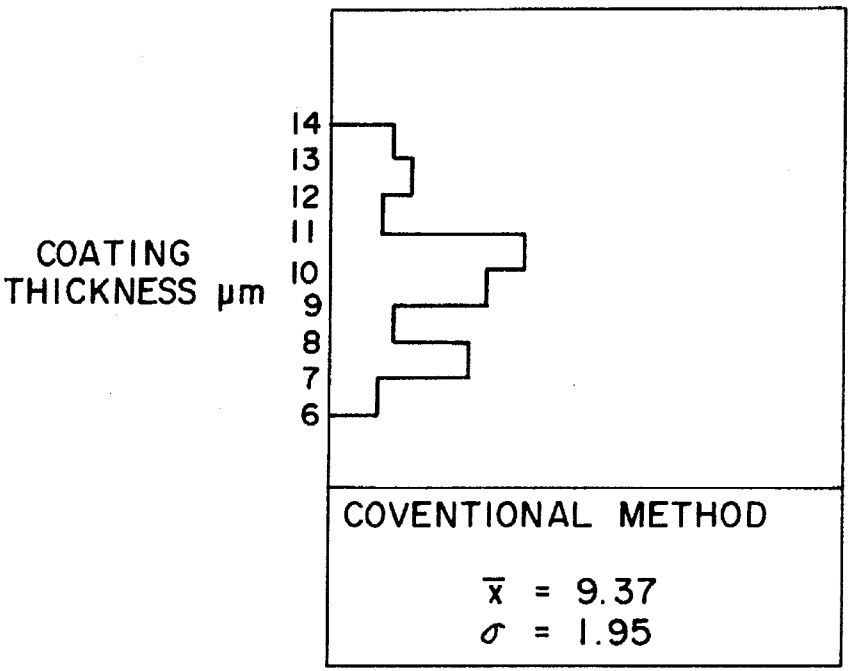
Figure 9B:
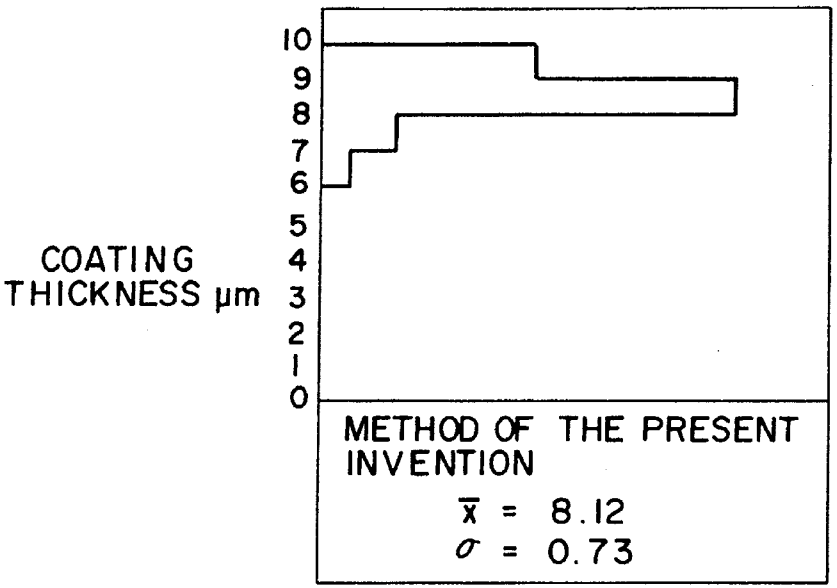
FIG. 9 is a graph showing the thickness distribution of the coating film on the outer circumferential surface of the piston ring.
Figure 9:
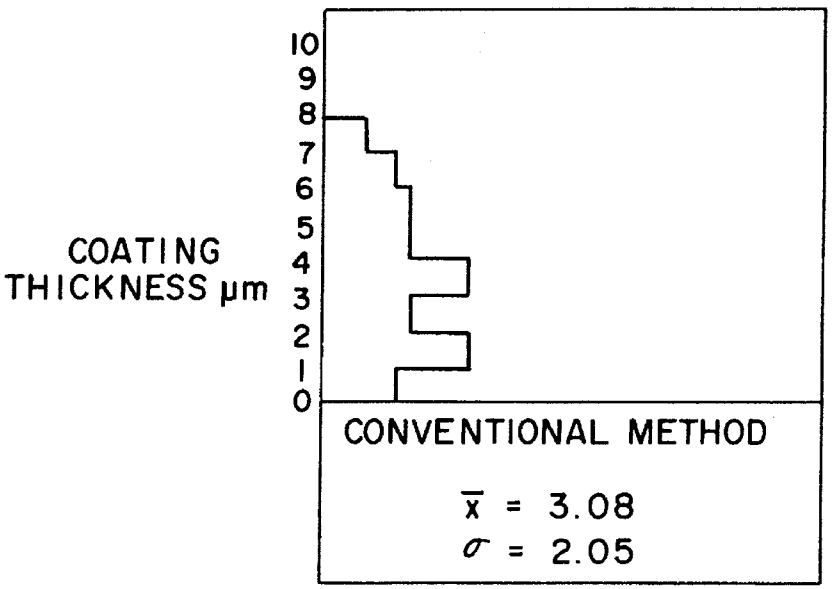
Figure 10:
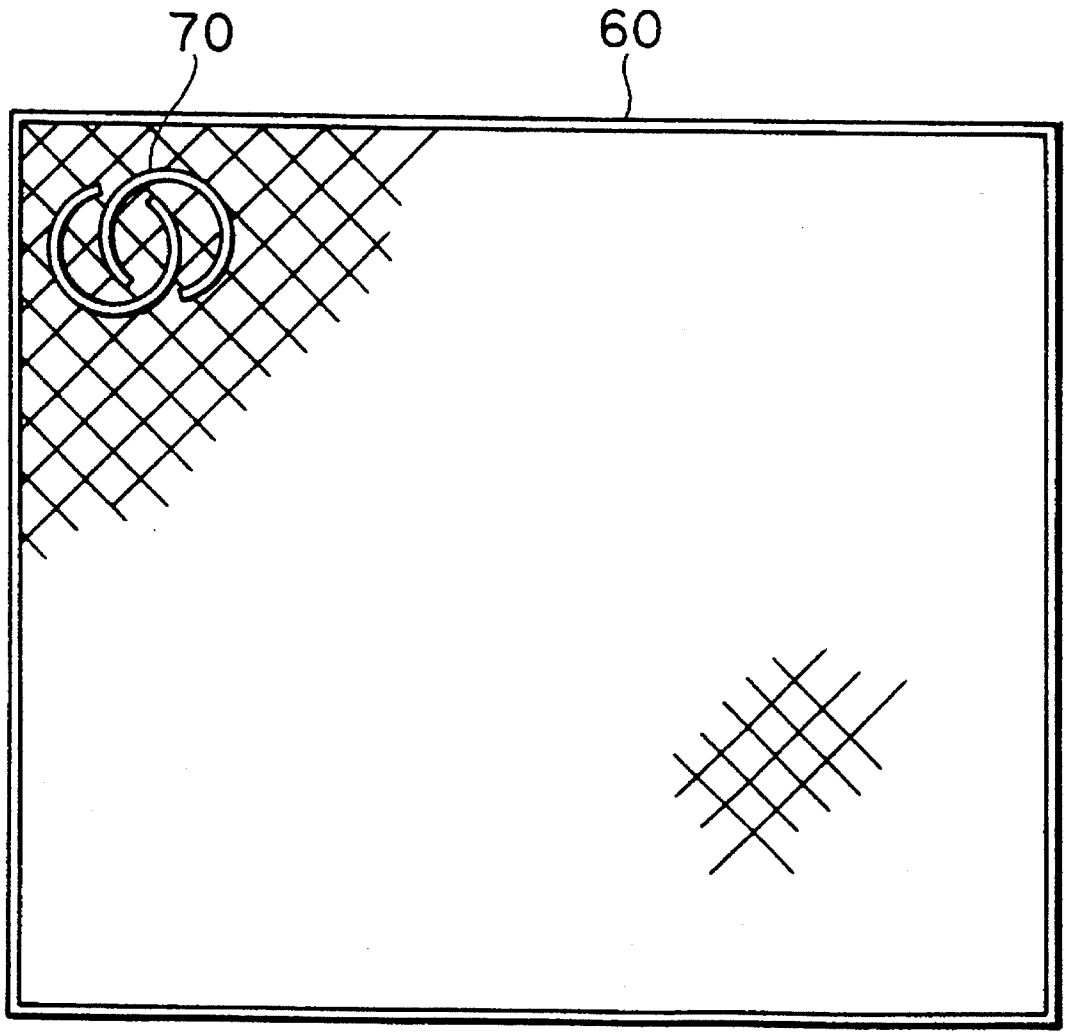
FIG. 10 is a plan view of the conventional embodiment showing a metal net on which piston rings are placed.

FIGS. 8 and 9 show the respective coating thickness distribution on the piston rings coated with the coating method of this invention and the conventional coating method. FIG. 8 shows the coating thickness on the lower surface of the piston ring. FIG. 9 shows the coating thickness on the outer circumferential surface of the piston ring. Examination of FIGS. 8 and 9 reveals that the coating film thickness is uniform when the coating method of this invention is used. In addition, the amount of coating material used for one piston ring with the coating method of this invention showed a decrease to within 25 percent in comparison with the conventional coating method.

The adhesion characteristics of the coating film with the method of this invention were proven in a cross-cut adhesion test. The test procedures were in conformance with JIS K 5400. After grid-like cross cuts on coating sample at a pitch of 1 mm were made, an evaluation was made with a tape adhesion test. In comparison with the conventional method which had 83 percent of the samples superior and 17 percent good; 100 percent of the samples of the method of the present invention were superior. This shows that few variations in adhesion of the coating film occur in the coating method of this invention when compared with the conventional coating method. Generally, phosphate treatment followed by resin coating is recommended to ensure good adhesion. However, the coating method of the present invention provides excellent adhesion making the phosphate treatment unnecessary.

Although the present invention has been described with reference to the preferred embodiments, it is apparent that the present invention is not limited to the aforesaid preferred embodiments, but various modification can be attained without departing from its scope.

What is claimed is:

1. A method for coating rings on a rotatable jig by means of a coating gun, said rings having upper and lower surfaces, an inner circumferential surface and an outer circumferential surface and a gap forming a pair of end surfaces, comprising the steps of:

holding a plurality of rings on said jig by the contraction force of said rings at mutually spaced intervals in the axial direction of said rings to expose said upper and lower surfaces, rotating said jig to revolve rings about the axis thereof, and coating at least one of the upper surfaces and the lower surfaces of said rings by means of said coating gun while said coating gun is moved along the direction of the row of said rings.

2. A method for coating rings as claimed in claim 1 by means of a pair of said coating guns comprising the steps of arranging said guns for substantially mutually opposed coating discharge, and applying a coating simultaneously to both the upper and lower surfaces of said rings while moving said guns along the direction of the row of said rings.

* * * * *